United States Patent [19]

Teichmann et al.

[11] 4,224,717

[45] Sep. 30, 1980

[54] CYLINDER SCREEN FOR A CARD

[75] Inventors: Paul Teichmann; Wolfgang Beneke; Heinrich Cremer, all of Mönchen-Gladbach, Fed. Rep. of Germany; Guy Ludwig, Mulhouse, France

[73] Assignee: Trützschler GmbH & Co. KG, Mönchen-Gladbach, Fed. Rep. of Germany

[21] Appl. No.: 948,309

[22] Filed: Oct. 3, 1978

[30] Foreign Application Priority Data

Oct. 8, 1977 [DE] Fed. Rep. of Germany ..... 2745474

[51] Int. Cl.[2] ..... D01G 15/34

[52] U.S. Cl. ..... 19/98; 19/95; 19/106 R

[58] Field of Search ..... 19/98, 95, 106 R

[56] References Cited

U.S. PATENT DOCUMENTS

| | | | |
|---|---|---|---|
| 153,429 | 7/1874 | English | 19/95 |
| 538,200 | 4/1895 | Rascoe | 19/95 |
| 656,871 | 8/1900 | White | 19/95 |

*Primary Examiner*—Louis Rimrodt

*Attorney, Agent, or Firm*—Spencer & Kaye

[57] ABSTRACT

A carding machine has a card cylinder, a doffer cooperating with the card cylinder and a cylinder screen situated underneath the card cylinder and generally conforming to the surface curvature thereof. The cylinder screen has a screen face including a screening portion and a screenless terminal portion. The terminal portion is arranged adjacent the doffer. At least one slot-shaped opening is provided in the screenless terminal portion of the cylinder screen. The opening has a length dimension which is oriented parallel to the width dimension of the cylinder screen.

6 Claims, 3 Drawing Figures

CYLINDER SCREEN FOR A CARD

BACKGROUND OF THE INVENTION

This invention relates to a carding machine for processing textile fibers and is more particularly concerned with a cylinder screen having a frame which has two parallel lateral components and a screening surface provided with a great number of apertures.

In a cylinder screen of the above-outlined type, the closed (aperture-free) zone of the screen structure oriented towards the doffer has at its outer end an enlarged rim (hereafter bead or beaded rim) having a radius of, for example, 5–15 mm. The bead is to facilitate, by virtue of its curved shape, the transfer and arrangement of the textile fibers from the cylinder to the doffer. The closed zone of the cylinder screen and the bead project into the space between the cylinder and the doffer. The air entrained by the cylinder forms an air cushion between the bead and the bight defined by the cylinder and the doffer, so that the transfer of the textile fibers from the cylinder to the doffer occurs in the vicinity of the bight. Since in the zone of the air cushion there is practically no air flow, the textile fibers which arrive in this zone, settle on the surface of the bead and are not carried away by the cylinder clothing. As additional fibers adhere to the first-settled individual fibers, a "fiber carpet" is formed which may, to a substantial extent, adversely affect the proper operation of the card. It is a further disadvantage that the compressed air introduced into the narrow gap between the cylinder clothing and the screen, is driven out laterally from the screen into the surrounding space.

SUMMARY OF THE INVENTION

It is an object of the invention to provide an improved cylinder screen of the above-outlined type from which the discussed disadvantages are eliminated and which, in particular, ensures the transfer of textile fibers from the cylinder clothing to the doffer clothing in a highly satisfactory manner.

This object and others to become apparent as the specification progresses, are accomplished by the invention, according to which, briefly stated, the closed (aperture-free) portion of the cylinder screen oriented towards the doffer has, along its width dimension (which is parallel to the cylinder axis) at least one slot-shaped opening.

The air entrained by the cylinder is introduced into the narrow gap between the cylinder clothing and the closed zone of the screen and is, in this manner, compressed. By providing the closed zone of the cylinder screen with a slot-shaped opening, such as a throughgoing channel, the entrained air may leave the zone between the cylinder clothing and the screen and can expand. One part of the air expands in the direction of the bead, so that in this manner a backflow of air is effected externally of the screen in the direction of the bead. The backflowing air stream thus combines with the above-discussed entrained air and forms therewith a circular flow, so that the textile fibers which dwell in the zone of the upper face of the bead are returned onto the cylinder clothing. In this manner it is ensured that there will occur an operationally reliable, satisfactory transfer of the textile fibers from the cylinder clothing to the doffer clothing, particularly without the appearance of the above-discussed "fiber carpet". Further, the compressed air introduced into the narrow gap between the cylinder clothing and the screen is prevented from being driven out laterally into the surrounding space.

Expediently, the distance of the slot-shaped opening from the bead of the screen is smaller than from the last aperture of the screen (that is, from the boundary of the screening portion of the cylinder screen); the ratio of these two distances is preferably 1:2. Preferably, the slot-shaped opening continues, in the direction oriented away from the cylinder, in a flaring zone, that is, the slot-shaped opening has a wedge-shaped cross-sectional configuration. In this manner the expansion of the air flow exiting in the direction of the bead is enhanced.

As a rule, a terminal portion of the closed zone of the cylinder screen deviates from the curvature of the screen face, so that the bead points towards the doffer. As a result, the distance of the bead from the cylinder clothing is greater than the distance of that part of the screen which conforms to the surface curvature. In this manner the end zone of the screen forms an angle with the surface curvature.

According to an advantangeous feature of the invention, that zone of the screen which is between the slot-shaped opening and the bead extends parallel to the cylinder surface, that is, it follows the surface curvature of the screen. It may, however, be advantageous to provide that in the zone of the screen between the slot-shaped opening and the bead only the bead follows the surface curvature, while that zone of the screen which extends from the bead towards the slot-shaped opening diverges from the surface curvature of the cylinder. Consequently, the bead is arranged closer to the cylinder clothing, whereby the return of the fibers from the zone of the bead to the cylinder clothing is facilitated.

DESCRIPTION OF THE PREFERRED EMBODIMENT

Figure 1:
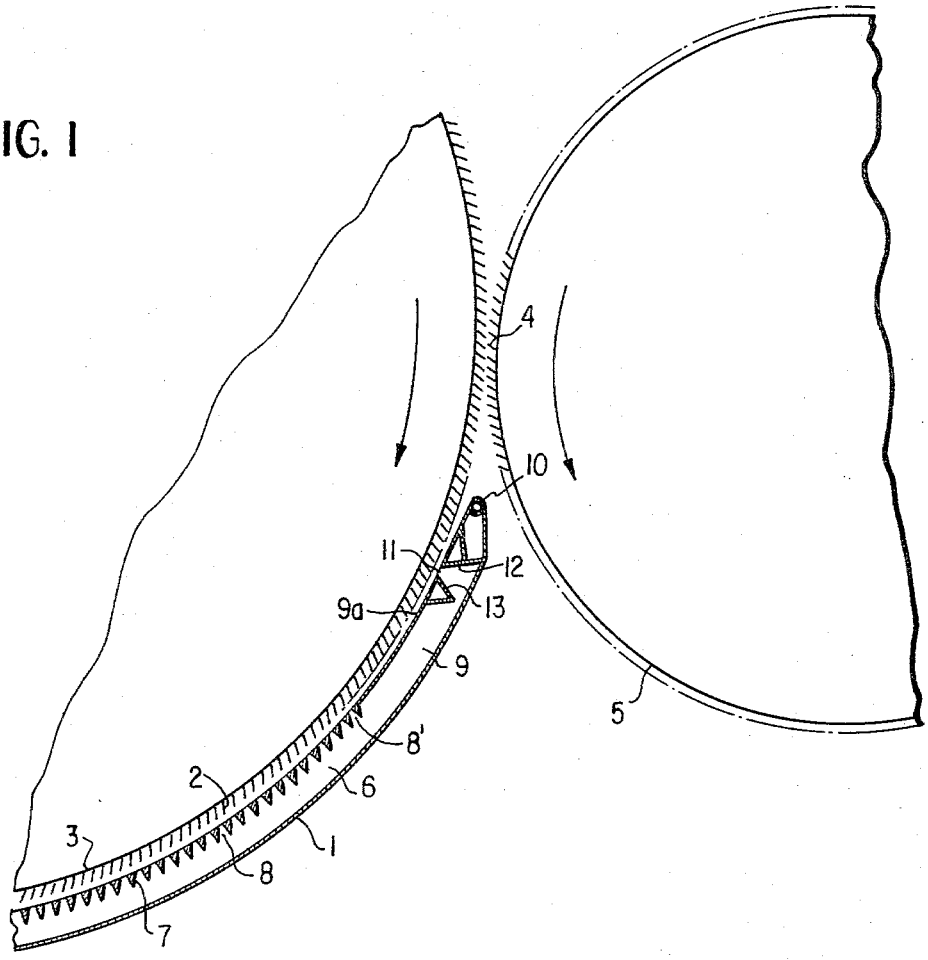
FIG. 1 is a schematic sectional elevational view of a preferred embodiment of the invention.

Turning now to FIG. 1 there is illustrated that terminal portion of a cylinder screen 1 which extends into the space bounded by a card cylinder 3 provided with a clothing 2 and a doffer 5 provided with a clothing 4.

The cylinder screen 1 is formed of a frame constituted by two parallel lateral parts 6 (only one is visible). Between the lateral parts, there are provided, for example, screen bars 7 which define between themselves a great number of passages 8. The terminal portion 9 of the cylinder screen 1 has a face **9*a* which extends from the last passage 8' to the beaded rim 10 (whose radius is, for example, 10 mm). The face 9*a* is void of screen bars 7 and thus the terminal portion 9 of the screen 1 is of continuous, closed configuration. The face 9*a* of the terminal portion 9 has, along its width, a throughgoing slot-shaped opening 11 which has a width of, for example, 3 mm. The distance between the opening 11 and the bead 10 is approximately 80 mm. The opening 11 continues in a flaring enlargement in a direction oriented away from the cylinder 3, that is, in an outward direction oriented towards the doffer 5. This flaring or wedge-shaped enlargement is formed of divergent boundary faces 12 and 13. The face 9*a* of the closed screen portion 9 extends parallel to the cylinder clothing 2 and thus follows the curvature of the cylinder screen 1. In the zone between the slot-shaped opening 11 and the bead 10, however, the face 9a deviates outwardly from the screen curvature and thus diverges from the cylinder clothing 2. The distance of the bead 10 from the continuation of the curved course of the cylinder screen 1 is approximately 8 mm. In this manner, between the cylinder clothing 2 and the face 9a between the bead 10 and the opening 11, a wedge-shaped space is provided into which the air entrained by the cylinder 3 is introduced. The air stream, after passing through the opening 11, expands by virtue of the flaring enlargement constituted by the components 12 and 13, flows in the direction of the bead 10 and combines with the air entrained by the cylinder 3**.

Figure 2:
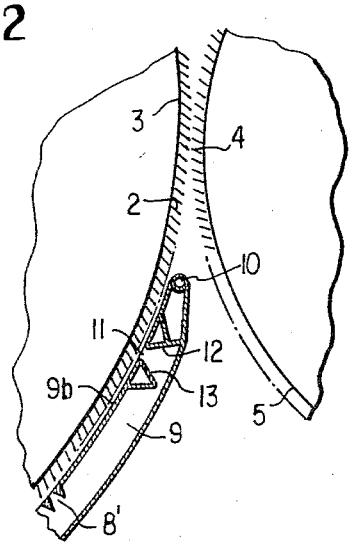
FIG. 2 is a schematic sectional elevational view of a first variant of the same embodiment.

Turning now to FIG. 2, there is shown an end portion of a cylinder screen 1 similarly to FIG. 1, in which, however, the face 9b of the terminal zone 9 between the opening 11 and the bead 10 extends parallel to the cylinder clothing 2, that is, it follows the curvature of the cylinder screen 1. The slot-shaped opening 11 has a width of, for example, 5 mm.

Figure 3:
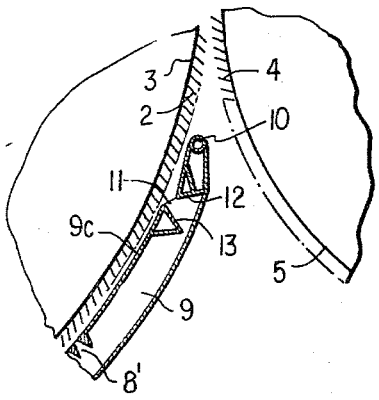
FIG. 3 is a schematic sectional elevational view of a second variant of the same embodiment.

Turning now to FIG. 3, there is shown the end portion 9 of a cylinder screen 1 which is similar to FIG. 2 except that only the bead 10 follows the curvature of the cylinder screen 1, while the face 9c of the terminal zone 9 diverges outwardly from the surface curvature of the cylinder screen 1, that is, away from the cylinder clothing 2 as viewed from the bead 10 towards the slot-shaped opening 11. The slot-shaped opening 11 has a width of, for example, 8 mm.

It is to be understood that the above description of the present invention is susceptible to various modifications, changes and adaptations, and the same are intended to be comprehended within the meaning and range of equivalents of the appended claims.

What is claimed is:

1. In a cylinder screen of a carding machine which has a card cylinder and a doffer cooperating with the card cylinder; the cylinder screen being situated underneath the card cylinder and generally conforming to the surface curvature thereof; the cylinder screen having a width dimension extending parallel to the cylinder axis, a screen face including a screening portion and a screenless terminal portion adjoining the screening portion along a boundary and having an outer end spaced from said boundary; the terminal portion being arranged adjacent the doffer; the improvement comprising means defining a slot-shaped opening provided in said screenless terminal portion and having a length dimension oriented parallel to the width dimension of said cylinder screen; the distance of said slot-shaped opening from said outer end being smaller than from said boundary.

2. A cylinder screen as defined in claim 1, wherein said cylinder screen terminates in a beaded rim situated between said cylinder and said doffer and forming said outer end of said screenless terminal portion.

3. A cylinder screen as defined in claim 1, wherein the ratio of the two distances is 1:2.

4. A cylinder screen as defined in claim 1, further comprising means defining a flaring continuation of said slot-shaped opening away from said cylinder.

5. A cylinder screen as defined in claim 1, wherein said cylinder screen terminates in a beaded rim situated between said cylinder and said doffer and further wherein said terminal portion of said screen face extends parallel to the surface of said cylinder in the zone between said beaded rim and said slot-shaped opening.

6. In a cylinder screen of a carding machine which has a card cylinder and a doffer cooperating with the card cylinder; the cylinder screen being situated underneath the card cylinder and generally conforming to the surface curvature thereof; the cylinder screen having a width dimension extending parallel to the cylinder axis, a screen face including a screening portion and a screenless terminal portion; the terminal portion being arranged adjacent the doffer; the improvement comprising means defining at least one slot-shaped opening provided in said screenless terminal portion; said opening having a length dimension oriented parallel to the width dimension of said cylinder screen; said cylinder screen terminating in a beaded rim situated between said cylinder and said doffer and following the curvature of said cylinder screen; said terminal portion of said screen face diverging from the curvature of said cylinder screen away from said cylinder as viewed from said beaded rim towards said slot-shaped opening.

* * * * *